US005859371A

United States Patent [19]

Hsieh

[11] Patent Number: 5,859,371

[45] Date of Patent: Jan. 12, 1999

[54] SPRING DEVICE OF A TORQUE WRENCH

[76] Inventor: Chih-Ching Hsieh, No. 64, Lane 107, Lientsun Rd., Fengyuan City, Taichung Hsien, Taiwan

[21] Appl. No.: 887,571

[22] Filed: Jul. 3, 1997

[51] Int. Cl.[6] ..... B25B 23/143

[52] U.S. Cl. ..... 73/862.23; 73/862.22

[58] Field of Search ..... 73/862.191, 862.21, 73/862.22, 862.23; 81/477, 478

[56] References Cited

U.S. PATENT DOCUMENTS 5,557,994 9/1996 Nakayama ..... 73/862.23 X

*Primary Examiner*—Joseph L. Felber

*Attorney, Agent, or Firm*—Oppenheimer Wolff & Donnelly LLP

[57] ABSTRACT

A spring device of a torque wrench includes a mediate member slidably received in a tube of the wrench and located between a block and an actuating member, wherein the block is movably connected to a positioning bolt extending from the tube and the actuating member contacts a shank in the tube. The other end of the shank has a head portion formed thereon. The actuating member has a rod extending therefrom and extending through a hole defined in the mediate member. A first spring is mounted to the rod between the mediate member and the actuating member, a second spring mounted to the rod between the mediate member and the block. The first and the second spring are maintained straight when being depressed.

2 Claims, 4 Drawing Sheets

SPRING DEVICE OF A TORQUE WRENCH

BACKGROUND OF THE INVENTION

1. Field of the Invention

The present invention relates to a spring device and, more particularly, to a spring device of a torque wrench and which is maintained straight in the torque wrench during operation.

2. Brief Description of the Prior Art

FIGS. 1 and 2 show a conventional torque wrench which includes a tube 32 with a first end into which a shank 53 is inserted and a second end into which a block 42, a stop 45 and a bolt means 44 are inserted wherein the bolt means 44 is threadedly engaged with a threaded hole 421 defined in a rear end of the block 42. A revolving grip 40 is threadedly mounted to the second end of the tube 32 which has numbers 33 marked thereon so as to indicate the value of torque to be set. The shank 53 is pivotally inserted into the tube 32 by a first pin 31 and has a head portion 30 formed one a first end thereof which extends from the tube 32. The shank 53 has a second end with a protrusion 52 disposed transversely thereto. An actuating member 50 is securely received in the tube 32 by a second pin 51 and has a roller 54 mounted to the second pin 51. A spring 43 is biasedly disposed between the actuating member 50 and the block 42. When using the torque wrench, a user rotates the revolving grip 40 to push the block 42 to depress the spring 43 until a front edge of the revolving grip 40 is in alignment with a number 33. When a torque having the same value as the number 33 set is transmitted from the wrench, the torque will force the roller 54 rapidly sliding across the protrusion 52 so that a sound is produced to notify the user the desired torque is achieved.

However, the spring 43 is found to be curved in the tube 32 when being depressed by the block 42 as shown in FIG. 2, this results the torque to be set is different from the number 33 alignment with the front edge of the revolving grip 40 because the positions of the numbers 33 are determined under a condition when the spring 43 is maintained straight when being depressed. Therefore, there has been at most 4% error when using the conventional torque wrench.

The present invention intends to provide an improved spring device of a torque wrench to mitigate and/or obviate the above-mentioned problem.

SUMMARY OF THE INVENTION

The present invention provides a spring device of a torque wrench which comprises a tube having a shank inserted therein from a first end thereof and a block inserted therein from a second end thereof. A head portion is connected to a first end of the shank which has a protrusion formed on a second end thereof. An actuating member is securely received in the tube and has a roller disposed thereto which contacts the protrusion. A positioning bolt is threadedly connected to the block and a revolving grip is threadedly mounted to a second end of the tube. The spring device comprises a mediate member slidably received in the tube between the block and the actuating member, the mediate member having a hole defined therein for a rod extending through the hole. A first spring mounted to the rod between the mediate member and the actuating member, a second spring mounted to the rod between the mediate member and the block.

It is an object of the present invention to provide a spring device of a torque wrench wherein the springs in the tube of the torque wrench are maintained straight when being depressed.

It is another object of the present invention to provide a spring device of a torque wrench wherein the torque transmitted from the wrench has at most 2% error compared with the value set by the revolving grip.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
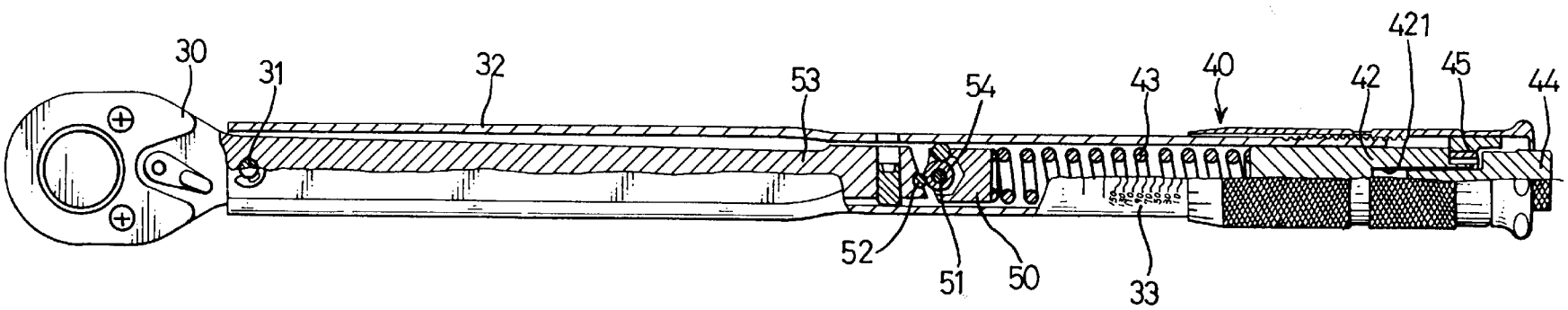
FIG. 1 PRIOR ART
FIG. 1 is a side elevational view, partly in section, of a conventional torque wrench.
Figure 2:
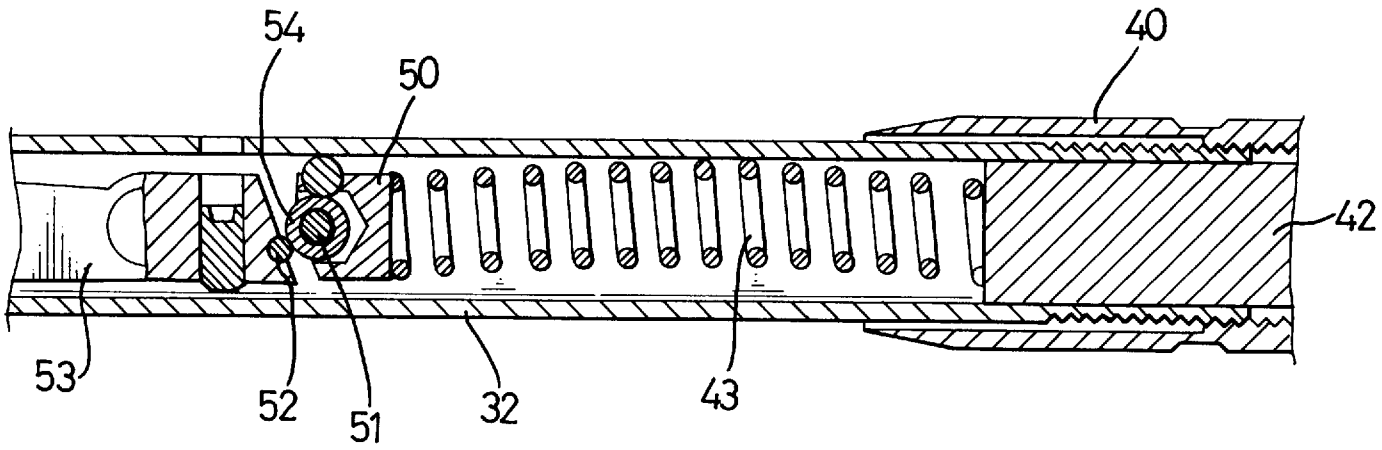
FIG. 2 PRIOR ART
FIG. 2 is a sectional view of a part of the torque wrench to show the spring in the wrench being curved when depressed.
Figure 3:
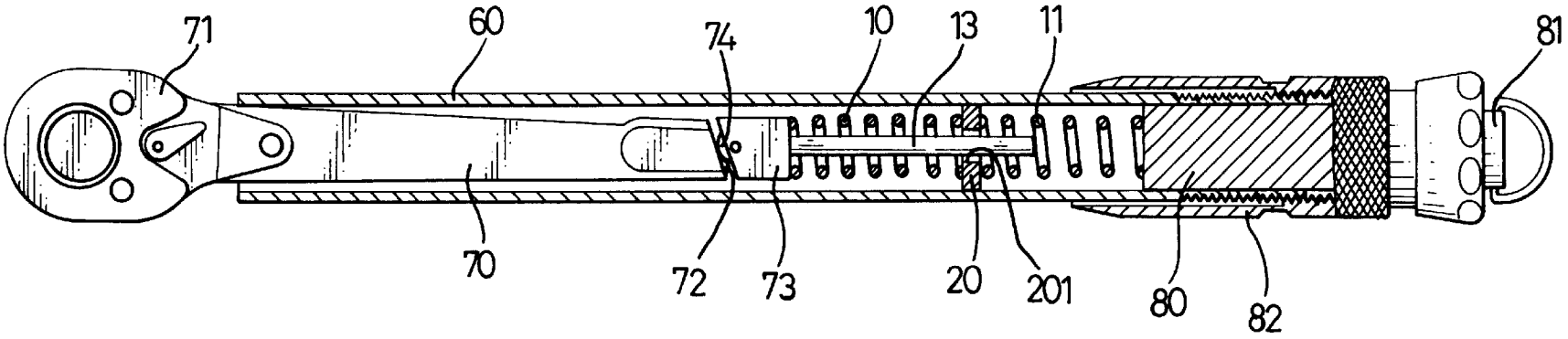
FIG. 3 is a side elevational view, partly in section, of a torque wrench in accordance with the present invention.
Figure 4:
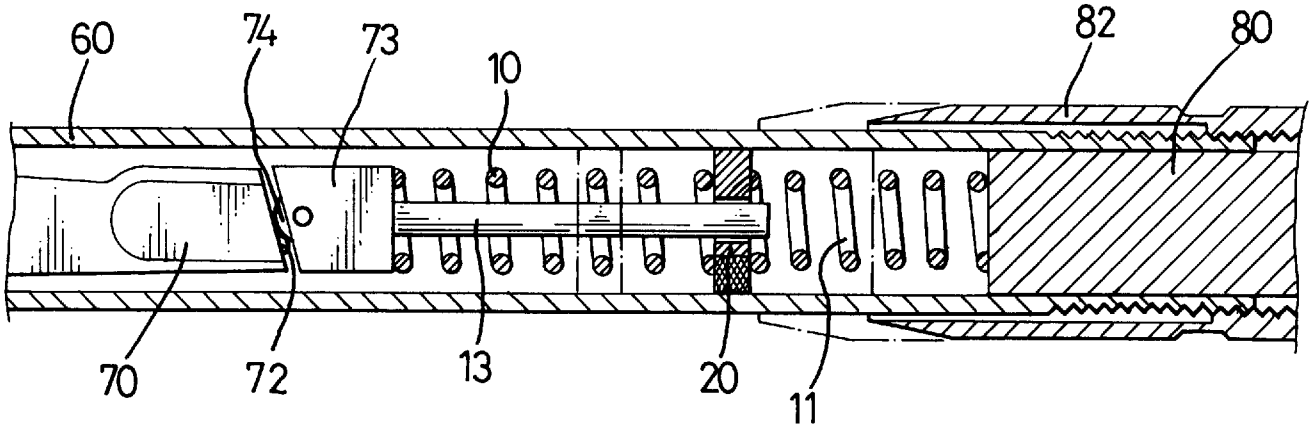
FIG. 4 is a sectional view of a part of the torque wrench to show the spring in the wrench maintained straight when depressed.

Referring to FIG. 3, a torque wrench comprises a tube 60 having a first end with a shank 70 inserted therein and a second end with block 80 inserted therein. The shank 70 has a head portion 71 connected to a first end thereof and a protrusion 72 formed on a second end thereof wherein the head portion 71 extending from the tube 60. An actuating member 73 is securely received in the tube 60 and has a roller 74 rotatably disposed thereto which contacts the protrusion 72. A positioning bolt 81 is threadedly connected to the block 80 and a revolving grip 82 is threadedly mounted to a second end of the tube 60 wherein the positioning bolt 81 extends through a rear end of the revolving grip 80.

The spring device in accordance with the present invention comprises a mediate member 20 slidably received in the tube 60 between the block 80 and the actuating member 73. The mediate member 20 has a hole 201 defined therethrough for a rod 13 extending through the hole 201 wherein the rod 13 extends from the actuating member 73. A first spring 10 is mounted to the rod 13 between the mediate member 20 and the actuating member 73, and a second spring 11 is mounted to the rod 13 between the mediate member 20 and the block 80.

When using the torque wrench, the block 80 is moved toward the mediate member 20 by operating the positioning bolt 81 and the revolving grip 82 to depress the first and the second spring 10, 11 so that the first and the second spring 10, 11 together with the mediate member 20 is moved in the tube 60. The rod 13 limits the first and the second spring 10, 11 from being curved during pressed so that the force exerting to the actuating member 73 can be more precisely indicated by the value (not shown) marked on the tube 60.

It is found that the torque transmitted from the wrench has having the spring device of the application has only at most 2% error compared with the value set by the revolving grip 80.

Although the invention has been explained in relation to its preferred embodiment, it is to be understood that many other possible modifications and variations can be made without departing from the spirit and scope of the invention as hereinafter claimed.

What is claimed is:

1. The spring device of a torque wrench which comprises a tube having a first end with a shank inserted therein and a second end with a block inserted therein, said shank having a head portion connected to a first end thereof and a protrusion formed on a second end thereof, an actuating member securely received in said tube and having a roller disposed to which contacts said protrusion, a positioning bolt threadedly connected to said block and revolving grip threadedly mounted to a second end of said tube, said spring device comprising a mediate member adapted to be slidably received in said tube and adapted to be located between said block and said actuating member, said mediate member having a hole defined therethrough for a rod extending through said hole, a first spring mounted to said rod and adapted to be located between said mediate member and said actuating member, a second spring mounted to said rod and adapted to be located between said mediate member and said block.

2. The spring device as claimed in claim 1 wherein said rod has one end thereof fixedly connected to said actuating member.

* * * * *